US005348806A

United States Patent [19]

Kojo et al.

[11] Patent Number: 5,348,806

[45] Date of Patent: Sep. 20, 1994

[54] CERMET ALLOY AND PROCESS FOR ITS PRODUCTION

[75] Inventors: Katsuhiko Kojo, Fukaya; Akibumi Negishi; Masayuki Gonda, both of Kumagaya, all of Japan

[73] Assignee: Hitachi Metals, Ltd., Tokyo, Japan

[21] Appl. No.: 946,849

[22] Filed: Sep. 18, 1992

[30] Foreign Application Priority Data

Sep. 21, 1991 [JP] Japan ..... 3-270291

[51] Int. Cl.[5] ..... B22F 3/00

[52] U.S. Cl. ..... 428/552; 75/238; 75/239; 75/240; 75/242; 75/244; 75/241

[58] Field of Search ..... 75/238, 239, 240, 242, 75/246, 244, 241; 428/552

[56] References Cited

U.S. PATENT DOCUMENTS

| | | | |
|---|---|---|---|
| 2,776,468 | 1/1957 | Steinitz | 75/230 |
| 3,752,655 | 8/1973 | Ramquist et al. . | |
| 4,533,389 | 8/1985 | Kapoor et al. | 75/123 B |
| 5,022,919 | 6/1991 | Shinozaki et al. | 75/238 |
| 5,149,595 | 9/1992 | Kojo et al. | 428/552 |

FOREIGN PATENT DOCUMENTS

| | | |
|---|---|---|
| 0349740 | 1/1990 | European Pat. Off. . |
| 2034038 | 12/1970 | France . |
| 2514788 | 4/1983 | France . |
| 60-131867 | 7/1985 | Japan . |
| 866119 | 4/1961 | United Kingdom . |
| 2109409A | 6/1983 | United Kingdom . |

OTHER PUBLICATIONS

European Search Report Dec. 14, 1992 "Highly abrasion resistant hard materials" Chemical Abstracts, vol. 104, No. 55273, Columbus, Ohio.

*Primary Examiner*—Donald P. Walsh
*Assistant Examiner*—Ngoclan T. Mai
*Attorney, Agent, or Firm*—Sughrue, Mion, Zinn, Macpeak & Seas

[57] ABSTRACT

A cermet alloy having a structure comprising a hard phase and a bonding phase, said hard phase comprising (1) at least one of MC, MN, and MCN, wherein M is at least one element selected from Ti, Zr, Hf, V, Nb, Ta, Cr, Mo, and W (2) at least one compound selected from (M,Mo)(B,C), M,Mo)(B,N) and (M,Mo)(B,CN) and (3) at least one Mo—Co—B compound; said bonding phase comprising Co. The cermet alloy has superior toughness and hardness, and can be worked by conventional sintering methods. The invention also includes a method for producing the cermet alloy.

18 Claims, 4 Drawing Sheets

X2,400

X16,000

X2,400

X16,000

CERMET ALLOY AND PROCESS FOR ITS PRODUCTION

FIELD OF THE INVENTION

The present invention relates to a cermet alloy useful as a material for tools, that is easily sintered and has extremely high hardness.

BACKGROUND OF THE INVENTION

A cermet alloy is a composite material combining the hardness characteristics of carbide and nitride, etc. with the toughness of metal. Ordinarily, the metal is present in the composite material in the form of a bonding phase and the carbide and nitride, etc., are present as hard particles.

The hard particles include carbides such as TiC (titunium carbide) and WC (tungsten carbide), etc., nitrides such as $Si_3N_4$ and TiN, etc., and borides such as $TiB_2$ and MoB, etc. Cermet alloys of TiC—Ni, TiC—WC—Co, and TiC—WC—Co—Ni in which Ni or Co (Cobalt) bonds these particles, and cermet alloys with this TiC replaced with TiCN, are well known.

In the ordinary case of cermet alloy production, its toughness is reduced when selection of the materials and the blending method are chosen to attain better hardness, but on the contrary, its hardness declines when aiming at better toughness. For example, in the case of the TiC—WC—Co group, if the content of Co is reduced, its hardness is improved while its toughness is adversely affected. Also, when the Co content is reduced, sintering will be difficult making it impossible to achieve the required density. On the contrary, when Co content is increased, its toughness is improved but hardness is declined. Furthermore, it is necessary to use a special sintering process under pressure such as hot pressing and hot isostatic pressing (HIP), etc. to produce a cermet alloy with excellent hardness and toughness, thus making the production process much more complicated.

SUMMARY OF THE INVENTION

One object of the present invention is to provide a cermet alloy having superior hardness without reduced toughness.

Another object of the invention is to provide a cermet alloy that is easily sintered, and that does not require a special sintering process such as hot pressing or hot isostatic pressing to achieve sufficient density.

A further object of the invention is to provide a cermet suitable for high density sintering under conditions of decompression or normal pressure.

An additional object of the present invention is to provide a cermet alloy with superior hardness, equivalent to that of a ceramic tool.

It has now been found that these and other objects of the invention are attained by a cermet alloy having a structure comprising a hard phase and a bonding phase, said hard phase comprising (1) at least one of MC, MN, and MCN, wherein M is at least one element selected from Ti, Zr, Hf, V, Nb, Ta, Cr, Mo, and W and (2) at least one Mo—Co—B compound; said bonding phase comprising Co.

The present invention also includes a method for producing this cermet alloy by the steps of (a) uniformly mixing (1) 10 to 45 vol % of a powder comprising MoB; (2) 5 to 25 vol % of a powder comprising Co; and (3) the balance being a powder comprising at least one of MC, MN, MCN, wherein M is at least one element selected from Ti, Zr, Hf, V, Nb, Ta, Cr, Mo, and W; (b) forming the mixture into green body; and (c) sintering the green body at a temperature of 1,300° to 1.600° C. for 10 to 120 minutes.

DETAILED DESCRIPTION OF THE INVENTION

Figure 1:
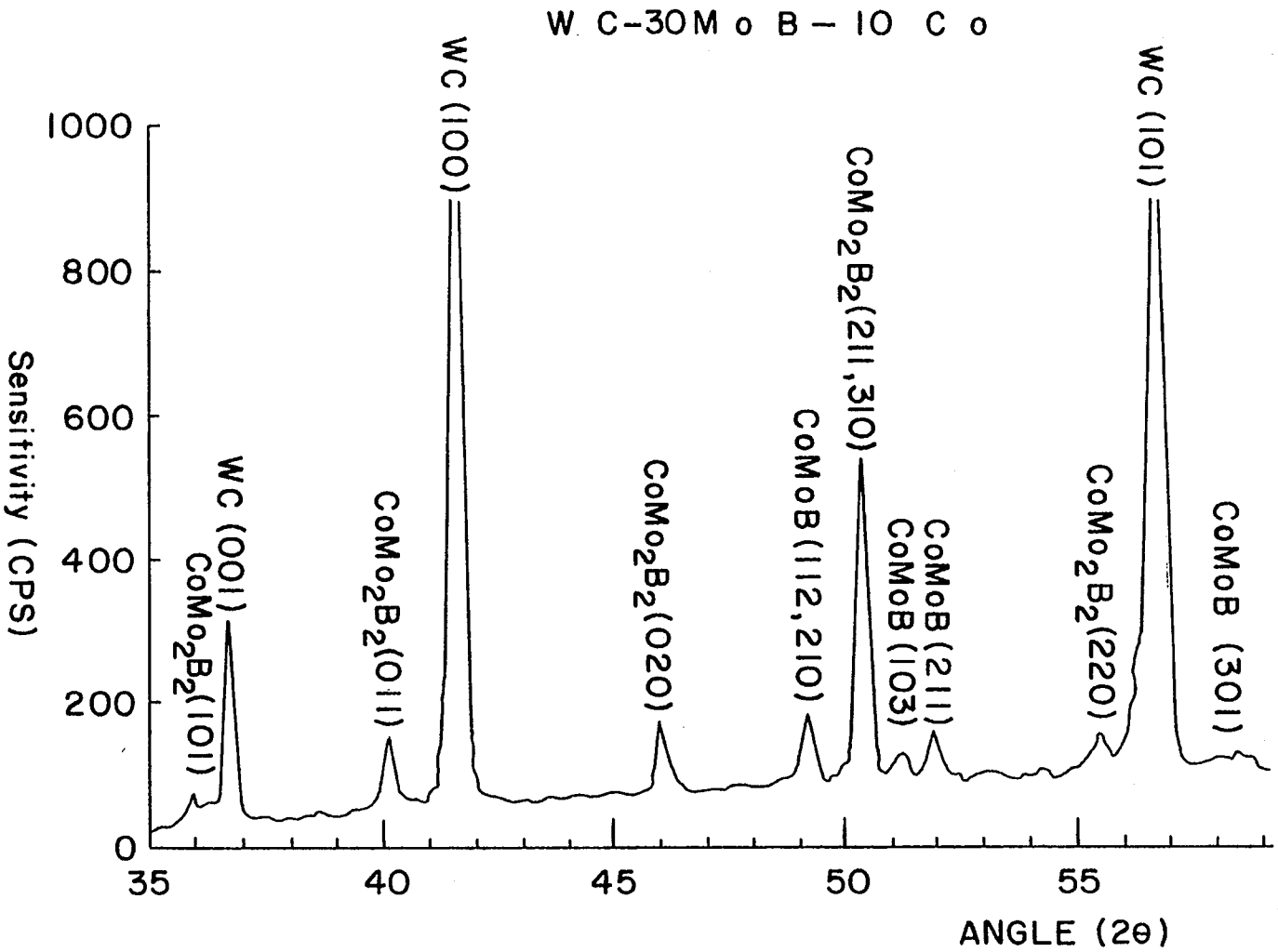
FIG. 1 shows an X-ray diffraction analysis for the sintered structure selected from Example.

The cermet according to the invention is produced by blending and sintering a powder of MoB, metallic Co powder and at least one powder of MC, MN, and MCN (where M is at east one transitional metal clement of Group 4a, 5a, or 6a of the Periodic Table). The cermet contains a hard phase with (1) at least one of MC, MN, and MCN as its main component, in combination with (2) a Mo—Co—B component, bonded by a bonding phase containing Co. In particular, M preferably represents Ti, Zr, Hf, V, Nb, Ta, Cr, Mo, or W; and is more preferably Ti, W, Mo, Ta, and Nb.

The cermet produced by blending and sintering the powders of MoB, Co, and at least one of MN and MCN, has excellent toughness and hardness, and a structure with the following characteristics:

(1) The hard phase composed mainly of at least one of MC, MN, and MCN contains at least one of MC, MN, and MCN and (M,Mo)(B,C) and/or (M,Mo)(B,N) and/or (M,Mo)(B,CN); and is composed of a core containing at least one of MC, MN, and MCN and a surrounding shell structure containing (M,Mo)(B,C) and/or (M,Mo)(B,N) and/or (M,Mo)(B,CN).

(2) In many cases, the hard phase with a Mo—Co—B compound as the main component contains CoMoB and $CoMo_2B_2$, and has a composite core/-shell structure consisting of a core of $CoMo_2B_2$ and a surrounding structure of CoMoB.

It is preferred that the metallic Co in the above bonding phase is 7% or less by weight. The hardness of the alloy is reduced when the metallic Co which does not contribute to the formation of the Mo—Co—B compound exceeds 7% by weight.

The cermet alloy according to the invention includes a structure having a hard phase and a bonding phase, where the hard phase contains (1) at least one of MC, MN, and MCN; (2) at least one of (M,Mo)(B,C), (M,Mo)(B,N), and (M,Mo)(B,CN); and (3) a Mo—-Co—B compound; and the bonding phase contains Co.

In this embodiment the hard phase containing at least one of MC. MN, and MCN and at least one of (M,Mo)(B,C), (M,Mo)(B,N), and (M,Mo)(B,CN) may be composed of particles having a composite core/shell structure, contaning a core of at least one of MC, MN, and MCN and a surrounding structure of one of (M,Mo)(B,C), (M,Mo)(B,N), and (M,Mo)(B,CN).

The present invention also includes a cermet alloy having a sturcture with a hard phase and a bonding phase, where the hard phase contains (1) at least one of MC, MN, and MCN; (2) a Mo—Co—B compound containing. CoMoB and $CoMo_2B_2$; and the bonding phase contains Co.

The present invention includes a cermet alloy having a structure composed of a hard phase and a bonding phase, where the hard phase contains (1) at least one of MC, MN, and MCN; (2) at least one of (M,Mo)(B,C), (M,Mo)(B,N), and (M,Mo)(B,CN); and (3) a Mo—Co—B compound containing CoMoB and $CoMo_2B_2$; and the bonding phase contains Co.

In a preferred embodiment, the cermet alloy of the invention has a structure composed of a hard phase and a bonding phase, the hard phase containing (1) TiC, (2) (Ti,Mo)(B,C), and (3) a Mo—Co—B compound; and the bonding phase contains Co.

The present invention also includes a cermet alloy having a structure composed of a hard phase and a bonding phase, the hard phase containing (1) TiC and (2) a Mo—Co—B compound containing CoMoB and $CoMo_2B_2$; and the bonding phase contains Co.

Another preferred embodiment according to the present invention is a cermet alloy having a structure composed of a hard phase and a bonding phase, the hard phase containing (1) TiC, (2) (Ti,Mo)(B,C), and (3) a Mo—Co—B compound containing CoMoB and $CoMo_2B_2$; and the bonding phase contains Co.

Another preferred embodiment of the present invention is a cermet alloy having a structure including a hard phase containing (1) WC and (2) a Mo—Co—B compound; and a bonding phase containing Co.

In the cermets alloys of the present invention, the Mo—Co—B compound is possibly replaced with a Mo—Co—B compound and a W—Co—B compound.

The present invention further relates to a method for producing a cermet alloy by the steps of:

(a) uniformly mixing (1) 10 to 45 vol % of a powder comprising MoB; (2) 5 to 25 vol % of a powder comprising Co; (3) the balance being a powder comprising at least one of MC, MN and MCN, wherein M is at least one element selected from Ti, Zr, Hf, V, Nb, Ta, Cr, Mo and W;

(b) forming the mixture into green body; and (c) sintering the green body at a temperature of 1,300° to 1,600° C. for 10 to 120 minutes.

Preferably, in this method the component represented by MC, MN and MCN is TiC or WC, In order to produce the cermet according to this invention, it is sufficient to blend and form (1) a powder of at least one of MC, MN, and MCN, (2) a powder of MoB, and (3) a powder of Co, followed by sintering in a non-oxidizing atmosphere.

It is possible to replace a portion of the powder of MoB with that of WB, and a portion of the powder of Co with that of Ni in the above producing process.

Uniform sintering becomes difficult when MoB exceeds 45 vol % in a blending ratio, and if Co is less than 5 vol %, strength and plasticity are reduced. Without being bound by theory, it is possible that the formation of the complex layer of Mo—Co—B compound created by the reaction between MoB and Co is inhibited. In addition, when Co is more than 25 vol %, the bonding phase is more than required, resulting in deterioration of the hardness of the cermet alloy.

When the particle size of the powder is too small, pores tend to be created during the sintering process as the result of increased content of oxygen, and if the size is too big, the sintering process tends to be hampered as the result of weakened activity of the powder. Accordingly, it is preferred that the particle size of the powder of MC, MN and MCN is from 0.5 to 45 μm, and more preferably 0.7 to 10 μm. The particle size of the powder of MoB is from 0.8 to 10 μm, and more preferably 1.0 to 5.0 μm. The Co powder preferably has a particle size of from 0.1 to 10.0 μm.

It is possible to sinter the powders to form a sintered cermet body using a pressure-free sintering process It is appropriate to use a non-oxidizing atmosphere such as nitrogen, argon, or a vacuum. Although sintering may be conducted by hot pressing or HIP, a sintered body of high density can be produced without adopting such a pressured sintering process. In the pressure-free sintering process, the sintering temperature is suitably from 1,300° to 1,600° C., especially in the range of from 1,400° to 1,600° C., and the sintering time is 10 to 120 minutes, especially in the range of from 30 to 90 minutes. It is not desirable to sinter at less than 1,300° C. because sintering does not sufficiently progress and the pores tend to remain, while it is also not desirable if the temperature exceeds 1,600° C., since the particles of the hard phase grow excessively. It is not desirable to sinter for less than 10 minutes, since the pores tend to remain, while it is also not desirable to sinter for longer than 120 minutes since the growth of particles of the hard phase tends to be increased.

In the process of the present Invention, Co is melted while the sintering process is in progress, and a fine structure is achieved through an accelerating sintering effect. The composite is created when hard particles are bonded firmly with Co. The Co not only fills the gap between the hard particles of MC, MN, and MCN, and the hard particles of MoB, but also invades the MoB particles to react with MoB and form $CoMo_2B_2$, and further to form a CoMoB phase on the surface of $CoMo_2B_2$. Since such complex phases of the Mo—Co—B group have an affinity higher than that of the MoB mono phase, the bonding strength between the Mo—Co—B phase and the Co phase is stronger in the cermet alloy of this invention. In many cases, the Mo—Co—B complex phase takes the form of a composite core/shell structure consisting of a core portion of $CoMo_2B_2$ and a surrounding surface shell portion at least partially covering the core, consisting of CoMoB after the MoB particle reacts with Co during the sintering process.

In addition to this, a complex phase made of (M,Mo)(B,C) , (M,Mo)(B,N), and (M,Mo)(B,CN) is formed at east on the surface of the particles of MC, MN and MCN, after a part of the MoB reacts with MC, MN and MCN during the above sintering process. This reaction forms the composite core/shell structure of MC, MN and MCN particles consisting of a core portion at least partially surrounded by a surface structure.

In this core/shell structure, the surface portion contains much more Mo and B than the core structure. Since such a composite structure (i.e., of MC, MN and MCN surrounded by (M,Mo)(B,C), (M,Mo)(B,N), and (M,Mo)(B,CN)) has a better affinity with Co than MC, MN and MCN, the composite particles are combined with Co by the (M,Mo)(B,C) and/or (M,Mo)(B,N)

and/or (M,Mo)(B,CN) phase. The composite grains have an inclined functional structure with a gradual change toward the side of Co from the MC, MN and MCN core portion, and have an excellent bonding strength.

It is also considered that a sufficiently fine sintered structure can be produced even without use of pressurized sintering processes, through the reaction-smelting of Co and a part of MoB during the above sintering process.

Since the bonding strength of both hard particles and the metallic Co matrix phases are extremely strong, the toughness of the cermet alloy in this invention is superior. Also, the use of very hard particles of MC, MN and MCN as the hard phase and formation of a Mo—Co—B compound by a part of the Co having less hardness after sintering creates excellent hardness of the cermet alloy. The cermet alloy of this Invention has Vickers hardness, Hv of at least 1,800.

It is possible to replace a portion of the powder of MoB with that of WB in the process of producing the cermet alloy of this invention without reducing the toughness and hardness of the cermet alloy.

The invention is now illustrated in greater detail with reference to the following specific examples and embodiments, but the present invention is not to be construed as being limited thereto.

EXAMPLE

WC, TiC, TaC, NbC, TiN, and TiCN with a particle size of 0.5 to 10 μm (for the component selected from MC, MN and MCN); MoB and WB with a particle size of 1.0 to 5.0 μm; and metallic Co and Ni with a particle size 5 to 10 μm were blended according to the ratio (vol %) indicated in Table 1. By forming this mixture under a pressure of 1,500 kgf/cm$^2$ (approximately 147×10 Pa), a green body having a size of 10 mm dia.×5 mm thickness was obtained. These green bodies were sintered at the respective temperatures of 1,500° C., 1,525° C. and 1,550° C. for 1 hr. to form a cermet alloy. The Vickers hardnesses Hv (1,500), Hv (1,525) and Hv (1,550); and crack resistance CR (1,500), CR (1,525) and CR (1,550); are shown in parallel in Table 1. In the table, ICP-Co is the content of metallic Co of the bonding phase as determined by plasma emission analysis. This is the result of analysis of Co in the solution after grinding the sintered structure to less than 352 mesh to get a sample for analysis, then selectively dissolving the metal phase out of it in acid solution with a filter. With this step, analysis can be conducted on the metallic Co remaining in the bonding phase of the sintered structure to ascertain its volume. Sample 21 in the table is a comparative example in reference to the conventional cemented carbide.

TABLE 1

| | Blending Ratio (vol %) | | | | | | | | | | Hv | Hv | Hv | CR | CR | CR | ICP—Co |
|---|---|---|---|---|---|---|---|---|---|---|---|---|---|---|---|---|---|
| No | WC | TiC | TaC | NbC | TiN | TiCN | MoB | WB | CO | Ni | (1500) | (1525) | (1550) | (1500) | (1525) | (1500) | (wt %) |
| 1 | 60 | — | — | — | — | — | 30 | — | 10 | — | 1880 | 2010 | 2160 | 42 | 41 | 43 | 0.84 |
| 2 | 60 | — | — | — | — | — | 5 | 25 | 10 | — | 2100 | 2200 | 2190 | 43 | 41 | 40 | 0.77 |
| 3 | 60 | — | — | — | — | — | 10 | 20 | 10 | — | 2110 | 2200 | 2200 | 42 | 38 | 40 | 0.33 |
| 4 | 60 | — | — | — | — | — | 15 | 15 | 10 | — | 2000 | 2130 | 2160 | 41 | 40 | 36 | 0.45 |
| 5 | 70 | — | — | — | — | — | 5 | 15 | 10 | — | 2240 | 2230 | 2230 | 43 | 49 | 48 | 0.65 |
| 6 | 70 | — | — | — | — | — | 5 | 15 | 5 | 5 | 2020 | 2030 | 2060 | 44 | 44 | 44 | 0.73 |
| 7 | 80 | — | — | — | — | — | 5 | 5 | 10 | — | 2100 | 2090 | 2060 | 53 | 53 | 55 | 0.75 |
| 8 | 80 | — | — | — | — | — | 5 | 5 | 5 | 5 | 2050 | 2020 | 2010 | 50 | 49 | 51 | 0.64 |
| 9 | — | 60 | — | — | — | — | 30 | — | 10 | — | 2010 | 2020 | 2080 | 40 | 41 | 43 | 0.63 |
| 10 | 50 | 10 | — | — | — | — | 30 | — | 10 | — | 2100 | 2015 | 2070 | 41 | 43 | 40 | 0.75 |
| 11 | 30 | 30 | — | — | — | — | 30 | — | 10 | — | 1970 | 1980 | 2000 | 35 | 37 | 38 | 0.88 |
| 12 | 10 | 50 | — | — | — | — | 30 | — | 10 | — | 2000 | 2010 | 2000 | 38 | 38 | 36 | 0.46 |
| 13 | — | — | 60 | — | — | — | 15 | 15 | 10 | — | 1500 | 1750 | 1790 | 35 | 40 | 33 | 0.63 |
| 14 | — | — | — | 60 | — | — | 15 | 15 | 10 | — | 1800 | 1900 | 1880 | 32 | 34 | 33 | 0.54 |
| 15 | — | — | — | — | 60 | — | 15 | 15 | 10 | — | 1760 | 1810 | 1790 | 43 | 45 | 41 | 0.55 |
| 16 | — | — | — | — | — | 60 | 15 | 15 | 10 | — | 1830 | 1880 | 1840 | 37 | 42 | 40 | 0.63 |
| 17 | 70 | — | 10 | — | — | — | 5 | 5 | 10 | — | 2080 | 2160 | 2100 | 42 | 48 | 44 | 0.78 |
| 18 | 75 | — | 5 | — | — | — | 5 | 5 | 10 | — | 2100 | 2190 | 2170 | 45 | 52 | 43 | 0.58 |
| 19 | 70 | — | — | 10 | — | — | 5 | 5 | 10 | — | 2100 | 2200 | 2180 | 41 | 47 | 46 | 0.64 |
| 20 | 75 | — | — | — | 5 | — | 5 | 5 | 10 | — | 2150 | 2230 | 2100 | 44 | 48 | 46 | 0.75 |
| 21 | 90 | — | — | — | — | — | — | — | 10 | — | 1830 | — | — | 36 | — | — | 5.77 |

Each cermet according to this invention has a Vickers hardness in excess of 1,800 and excellent crack resistance, since the CR value is also large.

FIG. 1 shows X-ray diffraction analysis of the sintered body of the example No. 1 in Table 1; WC with MOB-30 vol % and Co-10 vol % at temperature of 1,500° C. As is evident from FIG. 1, most of the Co reacts with MoB during the sintering process and forms $CoMo_2B_2$ and CoMoB which are Mo—Co—B compounds.

Figure 2:
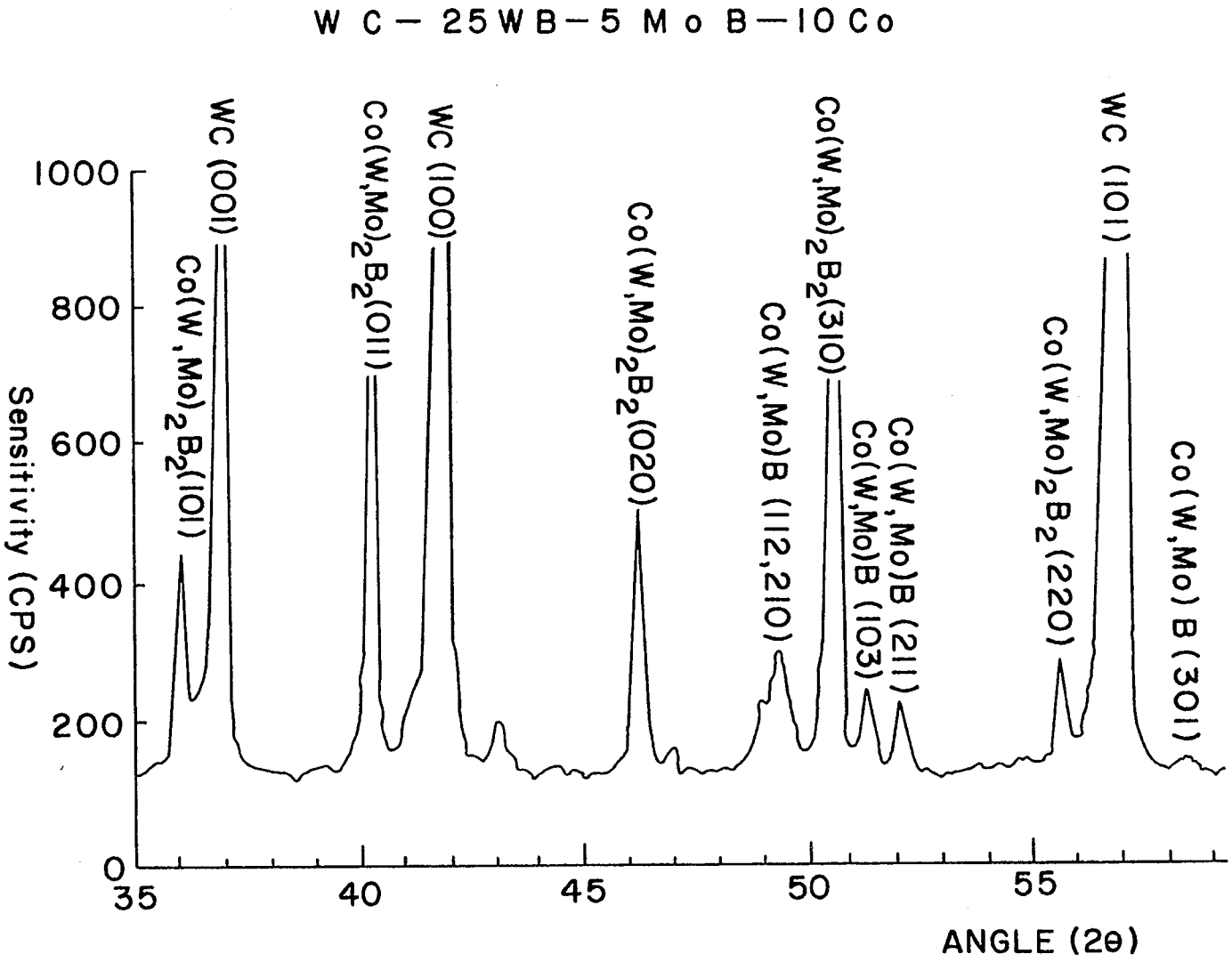
FIG. 2 shows another X-ray diffraction analysis for the sintered structure selected from Example.
Figure 3:
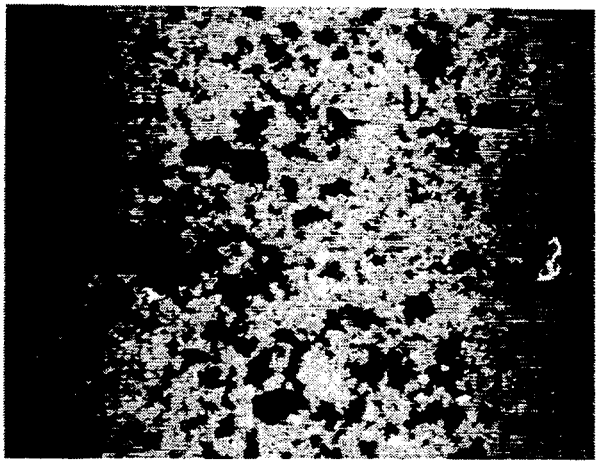
FIG. 3 is an SEM microphotograph (magnification 2,400 times) showing the metallic microstructure of a cermet according to the invention.
Figure 4:
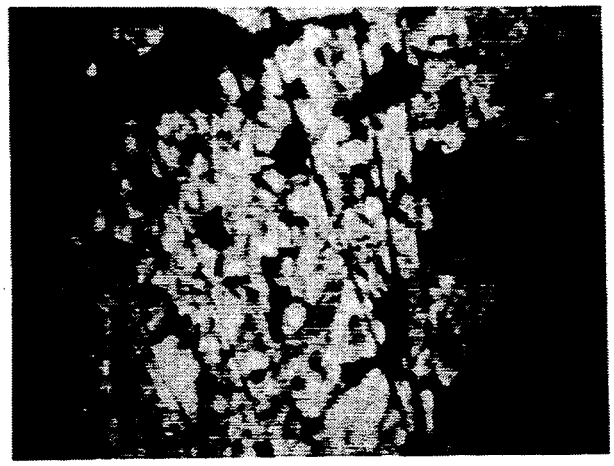
FIG. 4 is an SEM microphotograph (magnification 16,000 times) showing the metallic microstructure of a cermet according to the invention.
Figure 5:
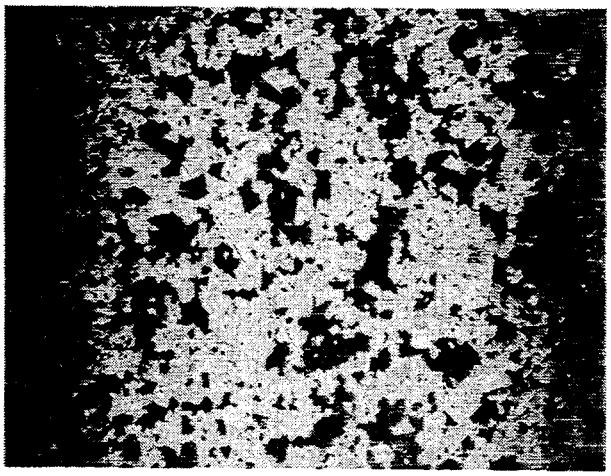
FIG. 5 is an SEM microphotograph (magnification 2,400 times) showing the metallic microstructure of a cermet according to the invention.
Figure 6:
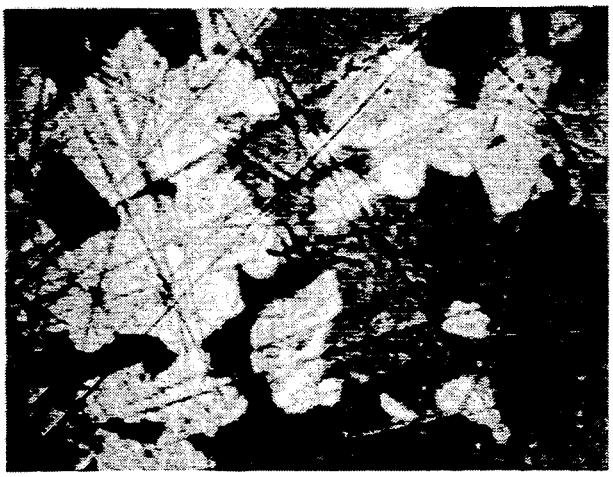
FIG. 6 is an SEM microphotograph (magnification 16,000 times) showing the metallic microstructure of a cermet according to the invention.

FIG. 2 shows X-ray diffraction analysis of the sintered body of the example No. 2 in Table 1; WC with MOB-5 vol %, WB-25 vol %, and Co-10 vol % at temperature of 1,525° C. As shown in FIG. 2, this sintered body has a complex phase structure composed with WC phase, $Co(Mo,W)_2B_2$ phase, Co(Mo,W)B phase, and Co phase.

In addition, X-ray diffraction analysis of the sintered body of the example No. 9 in Table 1; TiC with MoB-15 vol %, WB-15 vol %, and Co-10 vol % at temperature of 1,525° C.; shows that this sintered body has a complex phase structure consisting of TiC phase, {Ti,(Mo,W)}(B,C) phase, $Co(Mo,W)_2B_2$ phase, Co(Mo,W)B phase, and Co phase, This complex phase takes the form of a composite core/shell structure consisting of a core portion of TiC phase and a surrounding surface shell portion of {Ti,(Mo,W)}(B,C) phase.

FIG. 3, 4, 5, and 6 are SEM microphotographs showing the microstructure of the sintered body of the example No. 1 and 2 in Table 1 at a magnification of 2,400 times and 16,000 times respectively. As is evident from the figures, both cermet alloys have a structure of fine texture and high density.

As demonstrated by the above results, the cermet alloy produced by the process according to the invention provides an excellent high level of hardness and also fine texture, as well as superior toughness.

The invention has the advantage that a high density sintering process and product are attained under normal pressure, without relying upon HIP or hot pressing.

While the invention has been described in detail and with reference to specific embodiments thereof, it will be apparent to one skilled in the art that various changes and modifications can be made therein without departing from the spirit and scope thereof.

What is claimed is:

1. In a cermet alloy having a structure comprising a hard phase and a bonding phase, said hard phase comprising (1) at least one of MC, MN and MCN, where M is at least one element selected from Ti, Zr, Hf, V, Nb, Ta, Cr, Mo and W and (2) at least one Mo—Co—B compound, said bonding phase comprising Co, wherein the cermet alloy is characterized in that said hard phase further comprises at least one compound selected from (M,Mo)(B,C), (M,Mo)(B,N) and (M,Mo)(B,CN).

2. In a cermet alloy having a structure comprising a hard phase and a bonding phase, said hard phase comprising (1) at least one of MC, MN and MCN, where M is at least one element selected from Ti, Zr, Hf, V, Nb, Ta, Cr, Mo and W and (2) a Mo—Co—B compound comprising CoMoB and $CoMo_2B_2$, said bonding phase comprising Co, wherein the cermet alloy is characterized in that said Mo—Co—B compound comprises core/shell particles having a core comprising $CoMo_2B_2$, said core having thereon at least a partial shell comprising CoMoB.

3. The cermet alloy according to claim 1, wherein the metallic Co content of said bonding phase is at most 7.0 wt %.

4. The cermet alloy according to claim 1, wherein said hard phase comprises core/shell composite particles having a core comprising at least one of MC, MN, and MCN, said core having thereon at least a partial shell comprising at least one of (M,Mo)(B,C), (M,Mo)(B,N), and (M,Mo)(B,CN).

5. The cermet alloy according to claim 1, wherein said at least one Mo—Co—B compound is selected from CoMoB and $CoMo_2B_2$.

6. The cermet alloy according to claim 5, wherein said hard phase comprises core/shell composite particles having a core comprising at least one of MC, MN, MCN, said core having thereon at least a partial shell comprising at least one of (M,Mo)(B,C), (M,Mo)(B,N), and (M,Mo)(B,CN).

7. The cermet alloy according to claim 5, wherein said Mo—Co—B compound comprises core/shell particles having a core comprising $CoMo_2B_2$, said core having thereon at least a partial shell comprising CoMoB.

8. The cermet alloy according to claim 6, wherein said Mo—Co—B compound comprises core/shell particles having a core comprising $CoMo_2B_2$, said core having thereon at least a partial shell comprising CoMoB.

9. The cermet alloy according to claim 1, wherein M represents Ti and said hard phase comprises (1) TiC, (2) (Ti,Mo)(B,C) and (3) at least one Mo—Co—B compound.

10. The cermet alloy according to claim 9, wherein said hard phase comprises core/shell particles having a core comprising TiC, said core having thereon at least a partial shell comprising (Ti,Mo)(B,C).

11. The cermet alloy according to claim 2, wherein M represents Ti and said hard phase comprises (1) TiC and (2) a Mo—Co—B compound comprising CoMoB and $CoMo_2B_2$.

12. The cermet alloy according to claim 9, wherein said at least one Mo—Co—B compound is selected from CoMoB and $CoMo_2B_2$.

13. The cermet alloy according to claim 12, wherein said hard phase comprises core/shell particles having a core comprising TiC, said core having thereon at least a partial shell comprising (Ti,Mo)(B,C).

14. The cermet alloy according to claim 12, wherein said Mo—Co—B compound comprises core/shell particles having a core comprising $CoMo_2B_2$, said core having thereon at least a partial shell comprising CoMoB.

15. The cermet alloy according to claim 13, wherein said Mo—Co—B compound comprises core/shell particles having a core comprising $CoMo_2B_2$, said core having thereon at least a partial shell comprising CoMoB.

16. The cermet alloy according to claim 1, wherein M represents W and said hard phase comprises (1) WC and (2) at least one Mo—Co—B compound.

17. The cermet alloy according to claim 16, wherein said at least one Mo—Co—B compound comprises (1) CoMoB or (2) CoMoB and $CoMo_2B_2$.

18. The cermet alloy according to claim 1, wherein said Mo—Co—B compound is partially replaced with a W—Co—B compound.

* * * * *